US005779258A

United States Patent [19]

Luitz et al.

[11] Patent Number: 5,779,258

[45] Date of Patent: Jul. 14, 1998

[54] DAMPING DEVICE FOR COUPLING PARTS, FOR EXAMPLE A TOE CLAMP AND/OR A HEEL CLAMP

[75] Inventors: Max Luitz, Blaichach-Bihlerdorf; Hans Frick, Wiggensbach, both of Germany

[73] Assignee: Atomic Austria GmbH, Altenmarkt im Pongau, Austria

[21] Appl. No.: 380,345

[22] Filed: Jan. 27, 1995

[30] Foreign Application Priority Data

Jan. 28, 1994 [AT] Austria ..... 166/94

[51] Int. Cl.[6] ..... A63C 9/00

[52] U.S. Cl. ..... 280/618; 280/607

[58] Field of Search ..... 280/602, 607, 280/617, 618, 633, 634

[56] References Cited

U.S. PATENT DOCUMENTS

| | | | |
|---|---|---|---|
| 3,326,564 | 6/1967 | Heuvel | 280/602 |
| 4,022,482 | 5/1977 | Powerll | 280/607 |
| 4,979,761 | 12/1990 | Rohlin | 280/607 |
| 5,143,395 | 9/1992 | Mayr | 280/602 |
| 5,199,734 | 4/1993 | Mayr | 280/602 |
| 5,211,418 | 5/1993 | Scherübl | 280/602 |
| 5,380,031 | 1/1995 | Vitali et al. | 280/633 |

FOREIGN PATENT DOCUMENTS

| | | | |
|---|---|---|---|
| 372614 | 12/1980 | Austria . | |
| 396749 | 4/1993 | Austria . | |
| 0104185 | 10/1983 | European Pat. Off. . | |
| 2301966 | 7/1974 | Germany | 280/618 |
| 4124965 | 2/1992 | Germany . | |
| 684056 | 7/1994 | Switzerland | 280/617 |

*Primary Examiner*—Brian L. Johnson
*Assistant Examiner*—Frank Vanaman
*Attorney, Agent, or Firm*—Collard & Roe, P.C.

[57] ABSTRACT

A damping device for arrangement between parts of a coupling device and a surface of a ski comprises at least one bearing element consisting of a first material, the bearing element defining a hollow receiving chamber and having a supporting surface facing the surface of the ski and an opposite surface facing away from the surface of the ski. At least one damping element is inserted in the receiving chamber of the bearing element, the damping element having at least one contact surface facing the surface of the ski, the contact surface in an unstressed state protruding beyond the supporting surface of the bearing element in the direction of the surface of the ski. The bearing element defines bores for receiving fastening elements and is arranged adjacent the contact surface of the damping element and extends perpendicularly thereto, and the damping element has a lower hardness and a higher elasticity than the first material.

22 Claims, 3 Drawing Sheets

DAMPING DEVICE FOR COUPLING PARTS, FOR EXAMPLE A TOE CLAMP AND/OR A HEEL CLAMP

BACKGROUND OF THE INVENTION

1. Field of the Invention

The invention relates to a damping device for coupling parts, for example a toe clamp and/or a heel clamp, of a coupling device for arrangement between the coupling device parts and a surface of a ski.

2. The Prior Art

In a known damping device—according to U.S. Pat. No. 5,211,418—a plate-like, plastic damping element which consists in particular of structural foam, for example polyurethane, PVC, polyester, is arranged between a coupling device for a boot which consists of a toe clamp and a heel clamp, in particular for a ski boot, and a surface of a ski. To adapt the damping properties of this damping device, different measures are provided such as the integrated arrangement of reinforcement elements, spring elements, in order to achieve greater compressive strength and a different behavior of natural vibration. A disadvantage in these damping devices is that they have rather hard surfaces and, therefore, cannot dampen short-waved vibrations very well, thus causing the development of vibrations in the sole area of a ski boot which have unpleasant effects on the user when he uses the ski over a longer period of time. This leads in particular to faster tiring and, therefore, to restricted safety.

A known damping device—according to EP-A-0,104,185—is arranged between a coupling device, for example a ski binding, which connects a ski boot in a position of use with a ski, and the surface of the ski. This damping device is designed in two parts and consists of a metallic plate and an elastic covering layer which is arranged between the metal plate and the surface of the ski. The coupling device is fastened to the metallic plate which in its marginal portions is motionally connected to the ski by means of elastic layers. A disadvantage in this known embodiment is that due to the length of the ski binding, the assembly points of the elastic layers forming the damping device are at a great distance from the middle of the ski and hence from the ideal assembly point. In order that in such a device the vibration behavior of the ski is not influenced in a disadvantageous manner, the properties of the elastic layer must precisely match the constructional properties of the ski which makes this damping device very expensive.

SUMMARY OF THE INVENTION

It is the object of the present invention to create a damping device which allows for a dampening of the deformation movements of the ski without blocking them and which keeps away any vibrations from the sole of a boot.

This object of the invention is solved with a damping device for arrangement between parts of a coupling device and a surface of a ski, which comprises at least one bearing element consisting of a first material, the bearing element defining a hollow receiving chamber and having a supporting surface facing the surface of the ski and an opposite surface facing away from the surface of the ski. At least one damping element is inserted in the receiving chamber of the bearing element, the damping element having at least one contact surface facing the surface of the ski, the contact surface in an unstressed state protruding beyond the supporting surface of the bearing element in the direction of the surface of the ski. The bearing element defines bores for receiving fastening elements and is arranged adjacent the contact surface of the damping element and extends perpendicularly thereto, and the damping element has a lower hardness and a higher elasticity than the first material. The surprising advantage of this construction lies in that by means of the arrangement of an additional damping element in the damping device, a gradual damping behavior is achieved for different vibrations. The damping element presents an additional absorption path in the course of which the short-waved vibrations are degraded and the bearing elements can, therefore, be better matched to the deformation ratios and the developing long-waved vibrations, thus allowing for a higher assembly position for the coupling device with respect to the ski surface.

However, another object of the invention is also advantageous because the damping device can be universally used for different boot sizes.

According to a further advantageous feature, the guide between extensions of the bearing elements forms also vertical bearing surfaces which, when torsional stress occurs, activates a counter-moment and thus achieves a damping effect when this kind of stress occurs.

A preferred further embodiment is also described which achieves a large-volume filling of the bearing element with the damping element material and thereby a high degree of absorption in order to reduce the vibrations.

It is advantageous if the shore-hardness of the damping element is between 40 shores and 80 shores, preferably 60 shores, according to a further feature, with the result that the vibrations are effectively dampened in the prevalent frequency region.

According to another preferred feature of the invention, a point-support is achieved for the damping elements and they can be matched to the course of vibration which is different depending on the construction of the ski.

According to other advantageous features, element combinations are made possible which can be produced in a cost-effective manner, and a large number of material combinations allow for a precise matching to the vibratory behavior of different ski constructions.

According to another feature of the invention, a frictional connection between the coupling parts and the ski takes place by means of a spacer, and the damping device is not distorted and the damping effect not impaired.

Preferably, a direct surface contact between the surface of the ski and the spacer is prevented and a vibration bridge is provided in the region of the spacer due to a plastic layer running between said spacer and the surface of the ski.

This also provides an effective protection against the loss of the fastening element.

Advantageously, when a frictional connection is produced by fastening elements between the coupling device and the ski, the damping element is compressed in a spring-like fashion so that a permanent pressure is applied to the surface of the ski through which the development of short-waved vibrations is effectively prevented.

BRIEF DESCRIPTION OF THE DRAWINGS

For a better understanding of the invention, it is explained hereinafter in further detail by way of example only. In the accompanying drawings.

DETAILED DESCRIPTION OF PREFERRED EMBODIMENTS

Figures 1, 2:
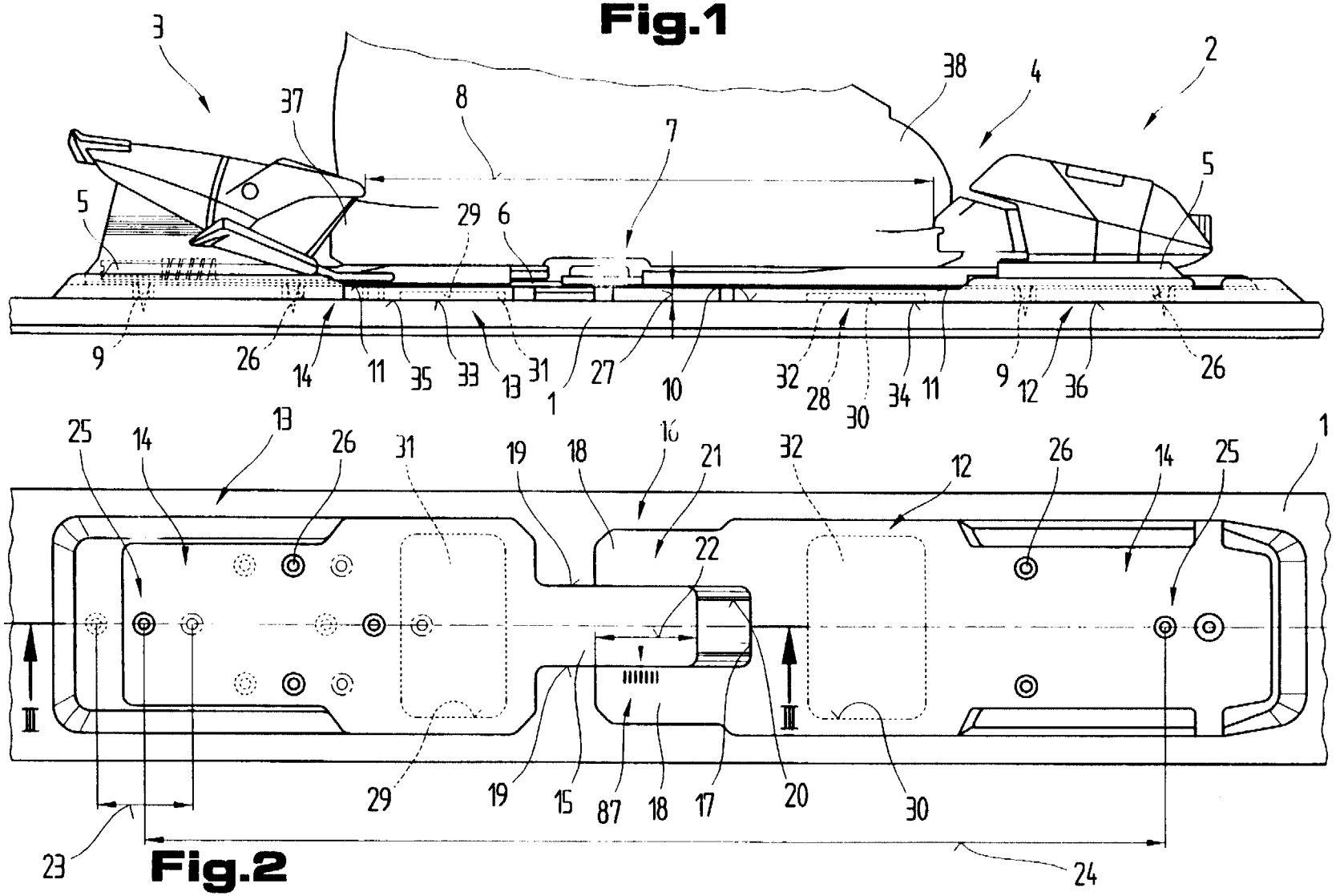
FIG. 1 is a side view and simplified, diagrammatic representation of a damping device in accordance with the invention which is arranged between a ski and a coupling device.
FIG. 2 is a top view of the damping device according to FIG. 1 without the coupling device arranged thereon.

FIGS. 1 to 4 show a coupling device 4 formed by a toe clamp 2 and a heel clamp 3. Toe claim 2 and heel clamp 3 can be adjustably mounted, for example in longitudinal guides 5 in the longitudinal direction of ski 1. A fastening strap 6 between toe clamp 2 and heel clamp 3 ensures a pre-settable distance 8 between toe clamp 2 and heel clamp 3 by means of an adjusting device 7. In the present exemplary embodiment, a further adjusting device is constructed for fine adjustment in heel clamp 3 in the form of a threaded spindle, which is positioned in heel clamp 3 and which threadedly engages fastening strap 6. Moreover, the fastening strap is coupled with toe clamp 2 for common movement, whereby it absorbs tension forces which occur when the ski boot is fixed and holds these forces away from ski 1. It is well known that a further advantage of this conception lies in that toe clamp 2 and/or heel clamp 3 can be displaced together in the longitudinal direction of ski 1 at distance 8 which is set by fastening strap 6. Known positioning devices which couple toe clamp 2 in the longitudinal direction of the ski with longitudinal guide 5 in certain positions may be used for this purpose. On the other hand, the other coupling part can slide freely, for example heel clamp 3, in its longitudinal guide 5 in the longitudinal direction of ski 1, whereby the latter is not impaired in its vibratory behavior and is able to adapt its position relative to ski 1 to the ground conditions in accordance with conforming ski deformations. Longitudinal guides 5 of coupling device 4 are fixed to ski 1 by means of fastening elements 9. Between a surface 10 of ski 1 and supporting surfaces 11 of longitudinal guides 5 of toe clamp 2 and heel clamp 3 of coupling device 4, plate-shaped bearing elements 12, 13 are arranged which form a damping device 14 and are provided with extensions 15, 16 which are facing towards each other.

Extension 16, for example, is constructed in a fork-like manner in order to form a recess 17. Fork-like projections 18 protrude parallel to a longitudinal central axis in the direction of bearing element 13 and overlap extension 15 at side faces 19. Side faces 19 together with bearing surfaces 20 of finger-like projections 18 form a guiding arrangement 21 between bearing elements 12, 13. A length 22 of finger-like projections 18 forms an adjusting area 23 for a distance 24 between fastening points 25 of bearing elements 12, 13 or longitudinal guides 5 which are supported by the latter.

Bearing elements 12, 13 have bores 26 through which fastening elements 9 of longitudinal guides 5 which are anchored in ski 1 pass. Bores 26 may have a greater diameter than fastening elements 9 so that a problem-free fastening of longitudinal guides 5 is made possible without any distortion of damping devices 14.

A thickness 27 of bearing elements 12, 13 is between 5 mm and 20 mm, preferably 10 mm. By thickness 27, the assembly plane is also determined for longitudinal guides 5 of coupling device 4. An assembly plane which is higher than surface 10 produces an improvement of the grip of the edges of ski 1 and a better force transfer of the controlling forces applied by the user, thus achieving a better steering behavior with much less force. Thereby, a better running comfort is achieved which leads to a longer, less tiring, and thereby safer, run.

Preferably, damping device 14 is made of a flexible plastic but other materials having flexibility can also be used. This way, damping device 14 can be a foamed plastic, for example a polyurethane-structural foam or any other corresponding plastics with sufficient strengths and elastic properties. It is, however, also possible that damping device 14 is formed by a sandwich component with several different layers, for example with the inclusion of a rubber layer or the like. Another possibility of the embodiment of damping device 14 lies in that the latter can be produced from any materials or in a sandwich structure in such a way that they can take up accordingly high pressure loads in the region of fastening elements 9 without deformation. However, the material of damping device 14 must be composed in such a way that at least the extension acts as a projecting bending rod when ski 1 is deformed perpendicular to its surface 10. Because damping device 14 is mounted between toe and heel clamp 2, 3 and longitudinal guides 5 and surface 10 of ski 1, the extensions project forward in a straight line and are oriented towards one another. If ski 1 is bent through between toe and heel clamps 2, 3 when stressed in the direction of the running surface or surface 10, a lengthwise balance may be possible at an appropriate longitudinal distance between the two bearing elements 12, 13 due to the different arc lengths of ski 1 and bearing elements 12, 13. However, extensions 15, 16 counter-act this deformation with a counter-force which corresponds to the bending resistance of bearing elements 12, 13. By selecting thickness 27 of bearing elements 12, 13 or respectively the deformation resistance in a plane running perpendicular to surface 10 of the ski in its longitudinal direction, a resistance building up with an increasing deformation of the ski can be established.

When using damping devices 14, quiet and oscillation and vibration-free skiing can be made possible. In order to keep away deliberately any oscillations and vibrations from the ski boot, receiving chambers 29, 30 which are formed by recesses 28 are provided, in particular in the heel and ball section in bearing elements 12, 13, which are filled with damping elements 31, 32.

Figure 3:
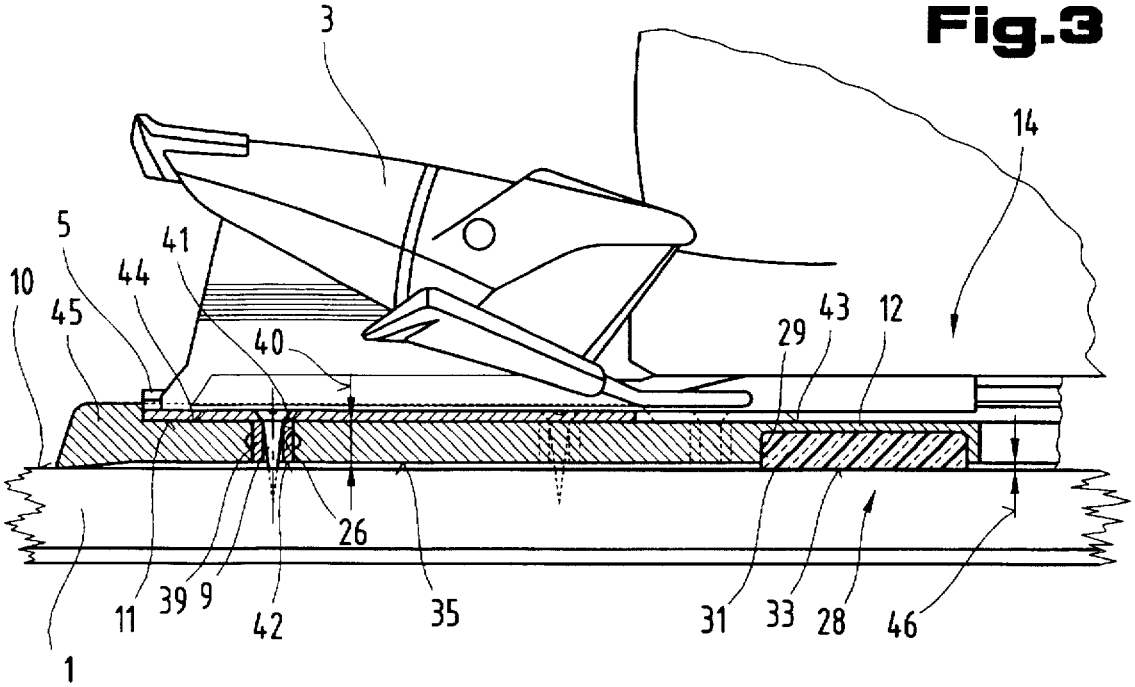
FIG. 3 is a side view, in a section taken along the lines III—III in FIG. 2, of a bearing element in accordance with the invention of a damping device for the heel clamp of the coupling device.
Figure 4:
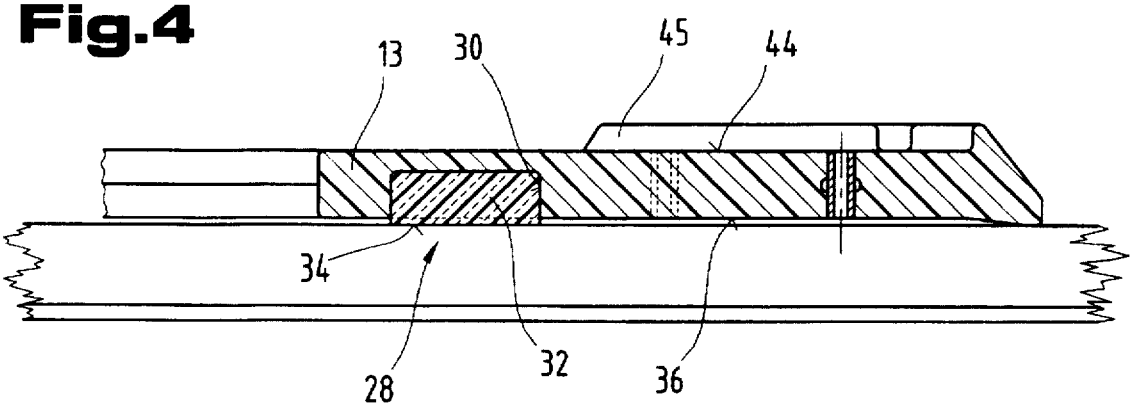
FIG. 4 is a side view, in section, of a bearing element in accordance with the invention of the damping device for the toe clamp of the coupling device.

As can be seen better from FIGS. 3 and 4, bearing elements 12, 13 comprise receiving chambers 29, 30 which are formed by recesses 28, which are facing towards surface 10 of ski 1 and in which damping elements 31, 32 are arranged. These damping elements 31, 32 form contact surfaces 33, 34 which bear on surface 10, and damping elements 31, 32 are constructed in such a way that contact surfaces 33, 34 slightly overlap supporting surfaces 35, 36 of bearing elements 12, 13.

When fixing toe clamp 2 and heel clamp 3 and their longitudinal guide 5 on ski 1, damping elements 31 are compressed by the tension force of fastening elements 9 in the direction of receiving chambers 29, 30 which causes a solid contact pressure on surface 10 of ski 1. Damping elements 31, 32 are made of an elastomeric material or rubber, in particular also of materials which lead to an effective damping of the vibrations.

By virtue of damping elements 31, 32, particularly high-frequency oscillations of ski 1 are damped in the region between toe clamp 2 and heel clamp 3. In addition, when the elastic properties of damping elements 31, 32 are appropriately set, oscillations which act in a vertical direction to surface 10 of ski 1 via ski 1 on sole 37 of ski boot 38 are effectively dampened.

These advantages mentioned last can be achieved in damping device 14 in accordance with the invention when the size of the adjustment area is designed accordingly also at different lengths of ski boot 38, i.e. different ski boot sizes. Consequently, one design of damping device 14 is enough to get by for different boot sizes when using a coupling device 4 or a ski binding.

Furthermore, FIGS. 3 and 4 show bores 26 in bearing elements 12, 13 for fastening element 9. With this fastening element 9, longitudinal guide 5, for example for heel clamp 3, is screwed down to ski 1 and bearing element 12 is fixed between heel clamp 3 and ski 1. Concentric to bore 26, sleeve-shaped spacers 39, for example of aluminum, plastic, steel etc., in bearing element 12 are anchored, a length 40 of spacer 39 corresponding to a thickness 27 of bearing element 12. Consequently, end faces 41, 42 of spacer 39 are coplanar with a supporting face 44 formed by a surface 43 and supporting face 35 of bearing element 12.

Supporting face 44 is surrounded at least in the longitudinal direction on both sides of longitudinal guide 5 by positioning elements 45 formed like a flange, which creates a defined area for the reception of longitudinal guide 5.

As shown, damping element 31 projects in an unstressed state beyond supporting face 35 by a distance 46, i.e. before fastening elements 9 act as a frictional connection. Furthermore, supporting face 35 of bearing element 12 is designed in a slightly concave shape in order to provide a tight seal with surface 10, for a contact of bearing element 12 in its marginal region with surface 10.

If fastening element 9 is tightened accordingly to form a frictional connection during assembly, damping element 31 is compressed by an approximate distance 46 and there is also an equalized thickness in the marginal region of bearing element 12 which achieves a snug fitting of supporting face 35 on surface 10.

The initial tension which is achieved by the compression of damping element 31 in the direction of ski 1 causes, similarly to vibration stoppers, as they are applied in the knot area of the covering of tennis rackets, a suppression of short-waved oscillations. Consequently, a quiet, vibration-free ski behavior is achieved and, thereby, the stress on joints and the risk of injuries is prevented.

In addition, by virtue of the material of damping element 31, for example an elastomer, rubber, etc., a high frictional value is achieved on contact surface 33, which provides a good frictional engagement between bearing element 12 and ski 1 and ensures an optimal force transfer for the control and guiding forces. The higher assembly plane of coupling device 4 with respect to surface 10 leads to an efficient transfer of the control and guiding forces to the running surface of ski 1 by means of which at the same expenditure of force an improved control and guiding behavior is achieved.

Figure 5:
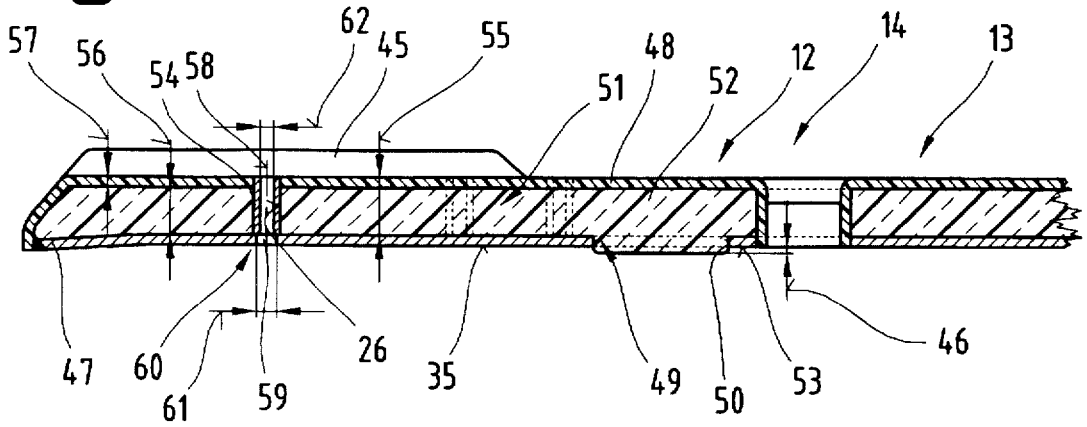
FIG. 5 is a side view, in section, of a further embodiment of the damping device.

FIG. 5 shows another embodiment of bearing elements 12, 13 of damping device 14. In this device, bearing elements 12, 13 have a plate-shaped lower housing part 47 and a cap-shaped upper housing part 48 which are connected to one another, for example welded. On upper housing part 48, for example a molded plastic part or an injection-molded part, positioning elements 45 having the form of a flange are integrally formed on. In lower housing part 47, a perforation 49 in the form of a wall opening 50 is arranged. Through this wall opening 50, inner chamber 51, which is bordered by lower housing part 47 and upper housing part 48, can be completely injected with an elastomeric material. This material forms now a large-volume damping element 52, which projects beyond supporting surface 35 and underside 53 of bearing element 12 in the region of wall opening 50 by a distance 46.

By determining the size of distance 46, the maximal oscillation amplitude of damping device 14 relative to surface 10 of ski 1 can be decided, by which a damping without jerks and a relative movement is made possible. With a suitable matching of the hardness or the elastic deformation properties of the elastomeric material in connection with distance 46, the damping characteristics for high-frequency oscillations with high amplitude or respectively low-frequency oscillations with low amplitude can be set. Thus, a damping of high-frequency oscillations with high amplitude is, for example, possible when a relatively low shore-hardness of the elastomeric material is used at a relatively great distance 46. On the other hand, it is possible that oscillations with greater energy can be better dampened in that a greater shore-hardness of the elastomeric material is selected and a shorter distance 46 so that the oscillation energy can be better reduced.

In the region of bore 26, a spacer 54 is arranged, in particular sprayed all around by elastomeric materials and anchored in the latter. A length 55 of spacer 54 corresponds to an internal spacing 56 between lower housing part 47 an upper housing part 48 in addition to a thickness 57 of upper housing part 48. In lower housing part 47, an opening 59 in the form of an oblong hole 60 is provided concentrically to a longitudinal central axis 58 of spacer 54, a length 61 of oblong hole 60 being greater than an internal diameter 62 of spacer 54, and, as can be seen from FIG. 6, a width 63 of oblong hole 60 is smaller than internal diameter 62 of spacer 54 and also of an outer diameter of fastening element 9 in the passage cross-section.

By imparting to opening 59 the form of oblong hole 60 having a smaller width 63 than internal diameter 62, a screw locking device is achieved which prevents the loss of screws in an effective manner if they are loose. Consequently, bearing elements 12, 13 can be provided with longitudinal guides 5 and fastening elements 9 before assembly without fastening elements 9 being lost.

Figure 6:
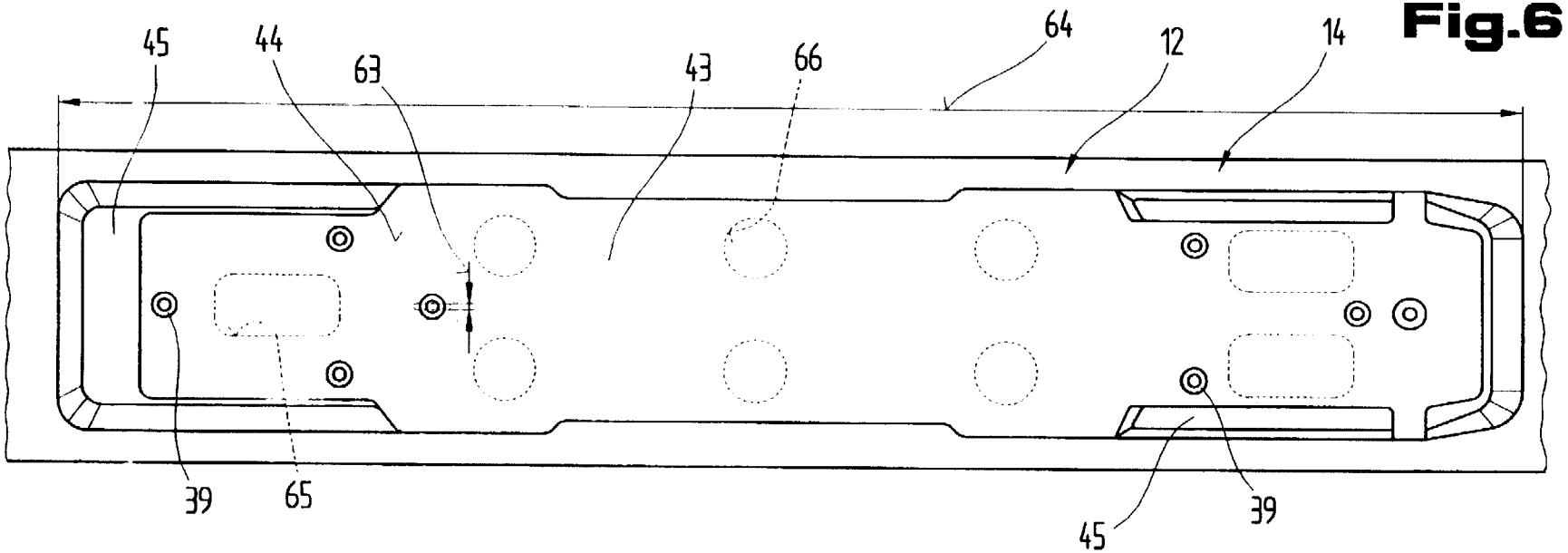
FIG. 6 is a top view of a further embodiment of the damping device.
Figure 7:
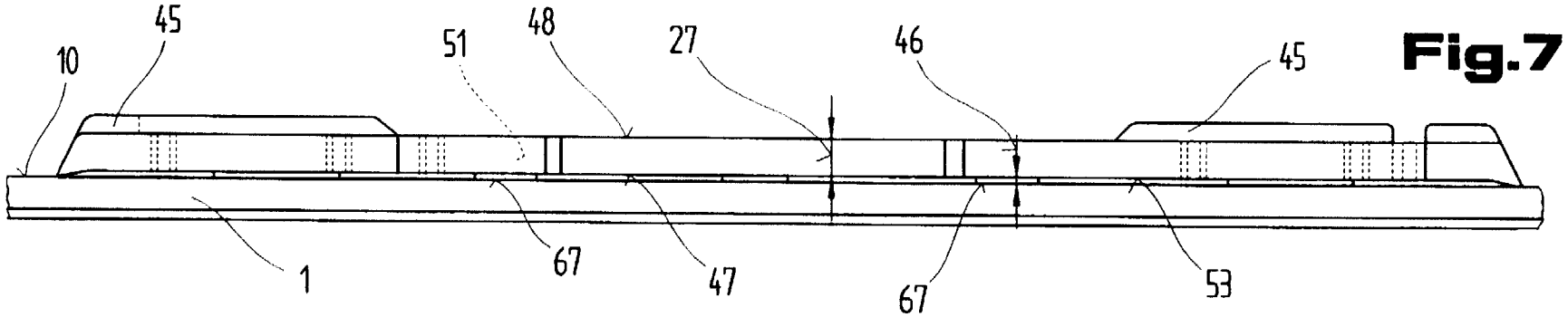
FIG. 7 is a side view of the damping device according to FIG. 6.

FIGS. 6 and 7 show a further embodiment of damping device 14. The latter is formed, for example, by a one-piece injection-molded part, a transfer-molded part, etc., of plastic. Here, an embodiment is possible wherein damping device 14 is formed by plate-shaped lower housing part 47 and cap-shaped upper housing part 48, which are connected to one another, for example glued together, welded, etc. In an embodiment comprising several pieces, there is, moreover, the possibility to provide between lower housing part 47 and upper housing part 48 connecting devices, for example clasps, by which they are connected in a detachable manner. This allows also for an exchange of damping elements, and a rapid adaptation to different damping behavior can be achieved.

Surface 43 of damping device 14 forms supporting faces 44 which are bordered by positioning elements 45 for coupling device 4. Across thickness 27 of damping device 14, spacers 39 are arranged. Inner chamber 51 between lower housing part 47 and upper housing part 48 is filled with the elastomeric material. In lower housing part 47 over a total length 64, several, for example differently formed, wall openings 65, 66 are arranged in which the elastomeric material protrudes from underside 53 and forms point-shaped contact surfaces 67 by which damping device 14 is supported on surface 10 of ski 1. These contact surfaces 67 may also protrude by a distance 46 over supporting surface 35 and underside 53 of bearing element 12, as has been indicated in FIG. 5. In the same way, it is possible to select the elastomeric material according to the above-mentioned embodiments to the different conditions of use.

In general, it should be noted that contact surfaces 67, act least in the surface region facing towards surface 10 of ski 1, have a higher frictional value than, for example, surface 10 of the ski or supporting face 35 and underside 53 of bearing element 12. This way, a dampening is also achieved at relative movements between surface 10 of the ski and bearing element 12, and the damping effect can also be used for these relative movements in the longitudinal direction of the ski, for example when the ski is bent through in order to slow down this deformation movement. But this surface roughness can also be achieved, for example, in that the uppermost layer of the material which consists of elastomeric material forming contact surfaces 67 is removed by a milling or shearing process so that an open-celled structure occurs, which, should the occasion arise, also leads to an increased adhesive effect by means of a so-called suction cup effect.

Consequently, it is possible to form contact surfaces 67 in different geometrical shapes and to associate deliberately the damping effect of the elastomeric material or rubber with certain surface areas in order to hold up on the one hand the development of oscillations and on the other hand to keep away occurring oscillations from coupling device 4 and the boot.

If, as can be seen from FIG. 2, in the region of guiding arrangement 21, i.e. extension 15 and projection 18, markings 87, which are facing towards each other, are applied for different boot sizes for the preadjustment of distance 8, damping device 14 can also be used as an assembly gauge to drill the fastening holes into ski 1.

It should be noted that for a clearer representation, partly an unproportional representation of the components to one another has been shown in the drawings.

Merely for the sake of completeness, it should be mentioned that individual combinations of features described in the exemplary embodiments can be provided in accordance with the invention.

We claim:

1. A damping device for arrangement between a surface of a ski and parts of a coupling device for a ski boot having heel and ball areas, which comprises (a) at least one bearing element consisting of a first material, the bearing element defining a hollow receiving chamber and having (1) an elongated supporting surface facing the surface of the ski for support of the bearing element on the ski surface, (2) an opposite surface facing away from the surface of the ski, (3) a region capable of taking up high pressure loads without deformation and wherein bores for receiving fastening elements are located, and (4) another region corresponding to the heel and ball areas of the ski boot, and (b) at least one damping element inserted in the receiving chamber of the bearing element, the damping element having (1) a lower hardness and a higher elasticity than the first material, and (2) at least one contact surface located in the other region and facing the surface of the ski, the contact surface in an unstressed state protruding beyond the supporting surface of the bearing element in the direction of the surface of the ski, and (3) the bores extending perpendicularly to the contact surface.

2. The damping device of claim 1, wherein the bearing element comprises a housing defining the receiving chamber and the housing surrounds the bores at least in the region of the supporting surface and of the opposite surface of the bearing element.

3. The damping device of claim 2, wherein the housing has a perforation beyond which the contact surface protrudes.

4. The damping device of claim 1, wherein the bearing element is comprised of one piece and comprises supporting faces for first and second coupling device parts spaced from each other in a longitudinal direction along the ski.

5. The damping device of claim 1, wherein first and second bearing elements are arranged between first and second coupling device parts spaced from each other in a longitudinal direction along the ski, and the bearing elements comprise overlapping extensions facing each other.

6. The damping device of claim 1, wherein the bearing element comprises a lower housing part and an upper housing part, the housing parts defining the receiving chamber.

7. The damping device of claim 6, wherein the housing parts are connected to each other.

8. The damping device of claim 6, wherein the housing parts are injection molded parts.

9. The damping device of claim 6, wherein the lower and upper housing parts are made of different materials.

10. The damping device of claim 1, wherein the damping element in the receiving chamber protrudes beyond the supporting surface of the bearing element through a perforation.

11. The damping device of claim 1, wherein the damping element is comprised of an elastomer selected from the group consisting of synthetic resin and rubber.

12. The damping device of claim 1, wherein the damping element has a hardness between 40 and 80 shores.

13. The damping device of claim 1, wherein the first material is a synthetic resin.

14. The damping device of claim 1, wherein the damping element has a higher friction coefficient than the first material.

15. The damping device of claim 1, wherein first and second coupling device parts spaced from each other in a longitudinal direction along the ski are a heel clamp and a toe clamp, and the bearing element comprises supporting faces for the heel and toe clamps and flanges for positioning the clamps.

16. The damping device of claim 1, wherein the damping element comprises a plurality of said contact surfaces spaced from each other.

17. The damping device of claim 1, wherein the bearing element comprises sleeve-shaped spacing elements defining bores for receiving fastening elements, the spacing elements extending perpendicularly to the surface of the ski and passing through the bearing element.

18. The damping device of claim 17, wherein the bearing element comprises a lower housing part and an upper housing part, the housing parts defining the receiving chamber, and the spacing elements extend between an inner surface of the lower housing part and an outer surface of the upper housing part.

19. The damping device of claim 18, wherein the lower housing part defines oblong holes in alignment with the bores, the oblong holes having a length corresponding to an inner diameter of the bores and a width less than the inner diameter.

20. The damping device of claim 17, wherein the spacing elements have a length corresponding to the thickness of the bearing element.

21. The damping device of claim 17, wherein the spacing elements are comprised of a material having a high resistance against pressure.

22. A damping device for arrangement between a surface of a ski and parts of a coupling device for a ski boot having heel and ball areas, which comprises (a) a bearing element consisting of a first material, the bearing element comprising (1) a flat lower housing part having a supporting surface facing the surface of the ski for support of the bearing element on the ski surface, (2) an upper housing part having an opposite surface facing away from the surface of the ski, the lower and upper housing parts defining a hollow receiving chamber therebetween and the lower housing part having an opening in one region of the bearing element, (b) an elastomeric damping element in the hollow receiving chamber, the elastomeric damping element having (1) a lower hardness and a higher elasticity than the first material, and (2) a contact surface facing the surface of the ski, the contact surface in an unstressed state protruding through the opening in the lower housing part beyond the supporting surface of the lower housing part in the direction of the surface of the ski, (3) the bearing and elastomeric damping elements defining bores in another region for receiving fastening elements for fastening the damping device to the surface of the ski, the bores extending perpendicularly to the contact surface, and (c) spacers in the bores, the spacers being anchored in the elastomeric material and being capable of taking up high pressure loads without deformation.

* * * * *